United States Patent [19]

Buffington et al.

[11] 4,357,175

[45] Nov. 2, 1982

[54] PROCESS FOR CLEANING THE INTERIORS OF VESSELS

[75] Inventors: Chester G. Buffington, Stratford, Conn.; Herbert H. Fang, Yorktown Heights, N.Y.; Barry A. Friedfeld, Shelton, Conn.; Thaddeus J. Kaniecki, Pompton Plains, N.J.; John W. Kennedy, Westport, Conn.; Chong-tan Liu, West Nyack, N.Y.; Morton Sternberg, Old Greenwich; Henry H. Feng, Orange, both of Conn.; Paul Y. Chen, Huntington Beach, Calif.; Waheed Mukaddam, Quincy, Mass.; Pattamadai E. Narasimhan, Bombay, India

[73] Assignee: Stauffer Chemical Company, Westport, Conn.

[21] Appl. No.: 281,455

[22] Filed: Jul. 8, 1981

Related U.S. Application Data

[63] Continuation-in-part of Ser. No. 139,062, Apr. 10, 1980, abandoned.

[51] Int. Cl.[3] ..... B08B 7/04

[52] U.S. Cl. ..... 134/10; 134/12; 134/22.19

[58] Field of Search ..... 134/10, 12, 22.19; 203/44

[56] References Cited

U.S. PATENT DOCUMENTS

| | | | |
|---|---|---|---|
| 3,042,553 | 7/1962 | Kearney et al. | 134/12 X |
| 3,434,881 | 3/1969 | Smith | 134/12 X |
| 4,136,624 | 1/1979 | Kato et al. | 134/19 X |

*Primary Examiner*—Marc L. Caroff

[57] ABSTRACT

An environmentally acceptable method for cleaning the interior of vessels comprises contacting the interior of a vessel with a solvent for the contaminant contained therein to produce a contaminated solvent, collecting the contaminated solvent from the vessel, separating essentially all of the contaminant from the contaminated solvent to recover essentially all of the solvent essentially free of the contaminant and produce a contaminant composition which is incineratable or can be made incineratable by blending with a combustible composition, such as fuel oil.

The contaminant may be separated from the contaminated solvent by distillation; in which case the overhead product may be washed with sulfuric acid and then neutralized with a base.

10 Claims, No Drawings

PROCESS FOR CLEANING THE INTERIORS OF VESSELS

This is a continuation-in-part of U.S. application Ser. No. 139,062, filed Apr. 10, 1980, now abandoned.

BACKGROUND OF THE INVENTION

1. Field of the Invention

This invention relates to processes for cleaning vessels, particularly those used for the storage and/or transportation of chemicals and other such materials, in an environmentally and economically acceptable manner. More particularly, this invention relates to a process for cleaning the interiors of a vessel contaminated with chemical residue by washing with solvents, recovering the contaminated solvents for subsequent reuse, and recovering the contaminant for environmentally-acceptable disposal.

2. Prior Art

In the transportation of commodities in tanks, which may be hauled over highways, by tank trucks, over railways by tank cars, over waterways by ships and barges or transported in drums, it is generally necessary and/or desirable at some point in time that the interior of the tanks be thoroughly cleaned of chemical residue. Cleaning is particularly important when the tank is to be refilled with a different commodity, in order to insure against contamination by the residue contained in the tank from the previous load. Cleaning of such tanks is also performed prior to any repair or testing of the tank.

It is estimated that there are hundreds if not thousands, of different commodities which are handled by rail tank cars, tank trucks and drums. Rail tank cars, and some tank trucks and drums, are generally in dedicated service (carrying one commodity only), and unless contaminated, are cleaned only prior to repair or testing. Non-dedicated tank trucks and drums are cleaned after every trip to prevent cross-contamination. It has been estimated that approximately 37,000 rail tank cars, 5 million tank trucks and 25 million drums are cleaned per year (see U.S. Department of Commerce, National Technical Information Service PB-280 726 "Source Assessment: Rail Tank Car, Tank Truck, and Drum Cleaning, State of the Art" by Monsanto Research Corp., Dayton, Ohio, April, 1978).

Due to the wide variety of chemical residues which must be cleaned from such tanks, it is very difficult to design and operate in any environmentally and economically acceptable manner, a single tank cleaning station which can handle such residues.

Generally, the processes for cleaning such tanks utilize cleaning agents such as steam, water, detergents and solvents. These agents, generally, are applied using steam hoses, pressure wands, or rotating spray heads placed through the opening in the vessel. Chipping and scraping of hardened or crystallized products is frequently required. Vapors from tanks used to store volatile materials may be sent to flares at such cleaning facilities. Vapors of materials such as anhydrous ammonia and chlorine are dissolved in water and become waste water constituents. Vapors not flared or dissolved in water are dissipated to the atmosphere.

The steaming, washing and/or flushing of rail tank cars, tank trucks and drums generally results in air emissions and waste water effluents containing pollutants. Air emissions from the cleaning of rail tank cars and tank trucks are both organic and inorganic vapors.

Water pollutants from cleaning of rail tank cars, tank trucks and drums are primarily oil, greases, high oxygen demand (COD), suspended solids, and toxic or odorous materials. By EPA estimates, ⅔rds of the tank truck industry discharges waste water effluent to municipal systems with little or no pretreatment. Where such pretreatment has been provided it is generally limited to sedimentation, neutralization and evaporation ponds and lagoons.

Until the late 1960's, little attention was given to waste water treatment from cleaning rail tank cars, tank trucks, and drums. This inattention was primarily due to the fact that the waste waters were generally low in volume, installations were small, and the environmental impact considered relatively minor compared to other industrial pollution sources. As indicated, waste water from an estimated ⅔rds of the installations were directed to municipal treatment systems, the rest were discharged directly to surface water streams with perhaps some oil separation treatment.

In recent years, the tank cleaning industry has been making an effort to improve waste treatment capabilities. No installation is known to have a completely satisfactory treatment system. Applicable state-of-the-art treatment technology is, for the most part, well known and has been used by manufacturing industries for several years. It has been thought that due to the wide variety of residues to be cleaned and the diversity of waste material streams that the use of a single specific process and installation for cleaning was impractical. For this reason, tank car and tank truck cleaning companies have been approaching their individual cleaning and pollution problems by using one or more combinations of methods. To date, however, there is no single practical and economical method for effectively cleaning and reducing the emission from rail tank car and tank truck cleaning operations.

Numerous processes and apparatus have been developed for the cleaning of vessels such as tank trucks, and rail tank cars and drums, see for example the following U.S. Patents:

U.S. Pat. No. 4,106,950 to Grismer—issued Oct. 28, 1977;

U.S. Pat. No. 3,434,881 to Smith—issued Mar. 25, 1969;

U.S. Pat. No. 3,281,269 to Watts—issued Oct. 25, 1966;

U.S. Pat. No. 3,188,238 to Lyon—issued June 8, 1965;

U.S. Pat. No. 3,046,163 to Kearney et al.—issued July 24, 1962;

U.S. Pat. No. 3,042,553 to Kearney et al.—issued July 3, 1962;

U.S. Pat. No. 3,033,215 to Miller—issued May 8, 1962;

U.S. Pat. No. 3,025,190 to Groom et al.—issued Mar. 13, 1962;

U.S. Pat. No. 3,944,924 to Sven-Erik Wiklundh et al.—issued July 12, 1960;

U.S. Pat. No. 2,092,321 to McFadden—issued Sept. 7, 1937;

U.S. Pat. No. 2,065,462 to Olsson—issued Dec. 22, 1936;

U.S. Pat. No. 2,045,752 to Butterworth—issued June 30, 1936;

U.S. Pat. No. 1,816,954 to Byerley—issued Aug. 4, 1931; and

U.S. Pat. No. 1,722,211 to Guardino—issued July 23, 1929.

None of the foregoing references appear to specifically describe a completely environmentally and economically acceptable process for cleaning chemical residues from vessels.

Some of the processes describe, in a general manner, reclaiming and reuse of solvents, see for example, Grismer and Smith, but they do not describe any specific economically and environmentally acceptable process for such reclamation, considering the wide variety of chemical residue or contaminants in the solvents.

Other references describe the use of complicated apparatus for cleaning the interiors of tanks, see for example, Watts.

Other references describe the use of portable cleaning apparatus for cleaning tanks in transit, see for example, Lyon, but say nothing about the waste treatment of the effluent from such cleaning processes.

Other processes describe the use of, for example, chlorinated hydrocarbon solvents in the vapor state of cleaning the interiors of tanks, see for example, both Kearney et al. references. Such processes require complicated heating and spraying equipment.

Most of the references also require the selection of a specific solvent to clean a specific chemical residue and utilize large quantities of such solvents.

SUMMARY OF THE INVENTION

An economically and environmentally acceptable method has now been found for the effective cleaning of the interiors of vessels.

In accordance with the method of the present invention, the interior of a vessel is washed with a solvent and the contaminated solvent is recovered from the vessel. The contaminated solvent is then processed to form a clean solvent, which can be reused, and a combustible contaminant composition, which can be disposed of in an environmentally-acceptable manner by incinerating it.

DETAILED DESCRIPTION OF THE INVENTION

In accordance with the present invention there is provided a method for cleaning a contaminant from the inner surface of a vessel comprising contacting the inner surface of the vessel with a solvent for the contaminant to remove at least a portion of the contaminant and produce a contaminated solvent, collecting the contaminated solvent from the vessel and separating essentially all of the contaminant from the contaminated solvent to recover essentially all of the solvent essentially free of the contaminant and produce a contaminant composition which is incineratable or can be made incineratable by blending with a combustible composition.

The solvents which are used in the process of the present invention are those which are liquid at ambient temperature and which are capable of removing the contaminant present in the particular vessel to be cleaned. While the solvents generally remove the contaminant by dissolving it to form a contaminated solvent solution, the contaminant can also be removed by forming a suspension of the contaminant in the solvent.

The solvents which are used are also capable of being essentially completely separated from the contaminants by at least one of several standard separation techniques, such as distillation, liquid/liquid extraction, combinations thereof and the like.

Solvents which can be used in the practice of the present invention include, but are not limited to:

1. Chlorinated aliphatic (typically lower aliphatic) liquids such as methylene chloride, trichloroethane, trichloroethylene, ethylene dichloride and perchloroethylene.
2. Aromatic liquids and solvents (typically monocyclic) such as benzene, alkyl monocyclic aromatics (toluene, o-, m-, and-/or p-xylene, ethylbenzene; etc.); hydroxyaromatics (phenol, o- and/or m-cresol and cresylic acid, etc.); benzyl compounds; aromatic amines (aniline, etc.); aromatic ethers (anisole, etc.); chlorinated aromatics (e.g. o-dichlorobenzene); nitrated aromatics; and heterocyclic aromatics such as pyridine.
3. Lower alkanones, e.g. ketones such as acetone, methylethylketone, cyclohexanone, etc.
4. Aldehydes such as benzaldehyde, acetaldehyde, etc.
5. Sulfoxides such as dimethylsulfoxide.
6. Organic acids, including sulfonic acids and lower carboxylic acids such as formic, lauric, myristic, acetic, and propionic.
7. Aliphatic amines including alkanolamines, such as mono-, di- and tri-, ethanolamines.
8. Aliphatic alcohols such as methanol, ethanol, propanol, (e.g. isopropyl alcohol), butyl alcohol, and fusel oil.
9. Non-aromatic-five and six-member carbocylic and heterocyclic solvents, with or without substitution on the ring, e.g. cyclohexanone, dioxane, etc.
10. Ethers, e.g. dibutyl ether.
11. Esters, e.g. carboxylic acid esters such as ethyl acetate.
12. Coal or petroleum distillates, e.g. petroleum ether, benzene, naphtha, Stoddards solvent.

Mixtures, reaction products, and derivatives of these solvents can be used, e.g. amine salts of organic carboxylic acids, so long as the product or mixture is liquid at normal ambient temperatures or temperatures of use, has adequate solvent powers, and has a viscosity suitable for pumping. Ordinarily, except for reduced vapor pressure and odor at room temperature, the salt forms of these solvents are less effective, particularly for paraffinic and other non-polar residues.

When chlorinated solvents are used care should be exercised to be sure that the presence of water is minimized, because chlorinated solvents in combination with water are known to promote corrosion under certain conditions.

Particularly preferred solvents are polar solvents and chlorinated aliphatic solvents.

It has been found that perchlorethylene and/or blends of perchloroethylene and cyclohexanone are particularly desirable solvents due to their ability to clean a wide variety of chemical residues and their safety characteristics, such as their high flash point. Although perchloroethylene can clean many chemical residues at ambient temperatures, it has been found that the ability of perchloroethylene to clean is enhanced by raising the temperature above about 50° C. At such temperatures, perchloroethylene cleans most epoxy, alkyd, and acrylic resins, which are generally considered to be difficult-to-clean residues.

Other types of residues, such as certain polyesters and phenolic resins, and hydrolized isocyanate films can be removed by mixed perchloroethylene and cyclohexanone. The greater the quantity of cyclohexanone in such a blend the greater the ability of the solvent to clean such residues. It has been found that about a 60/40 to 50/50 volume blend of perchloroethylene and cyclohexanone dissolves almost all such residues, a 50/50 blend being preferred.

One of the preferred solvents of this invention, perchloroethylene, has no flash point and when loaded with up to 30% by volume of mixed oil residues, maintains a flash point greater than 160° F. (71° C.). A 50/50 by volume perchloroethylene and cyclohexanone blend has a flash point of greater than 230° F. (110° C.). When loaded with up to 20% by volume of mixed polyester phenolics this blend has a flash point of about 110°-130° F. (50.2°-54° C.). The perchloroethylene and cyclohexanone blends generally have a low tolerance to high concentration of low flash organics, although the blends per se are "non-flammable". For this reason, it may be desirable, although not necessary, that before using such blends for washing or rinsing the tanks that perchloroethylene be used to wash or rinse, i.e. extract, for example, the high volatile organics from the resins present.

To help maintain optimum cleaning ability for the solvents and/or to maintain as high a flash point as possible (preferably greater than 160° F.), the concentration of residue in the solvents should be maintained below a certain level. It has been found that for perchloroethylene a preferred residue concentration is no greater than about 25% (by volume). A preferred residue concentration for a 50/50 by volume perchloroethylene and cylcohexanone is no greater than about 25% (by volume). When these concentrations of residue are reached the solvents should preferably be processed and recovered in accordance with the method of this invention.

A major benefit of this present process for cleaning tanks is that it is environmentally acceptable. The solvents are reused with only a minimal amount of makeup required, solvent vapors are captured and disposed of in an environmentally acceptable manner, and the chemical residue is properly disposed of in an environmentally acceptable manner.

The process for recovering organic solvents from the spent wash solvent and disposing of the residues therefrom has been found to be useful not only in the process of this invention for cleaning tanks, but has also been found to be useful, generally, for recovering certain type solvents from certain type compositions. These solvent compositions are generally those containing a "desired solvent", for example, those listed under the section "Solvents" in this specification (particularly chlorinated aliphatic solvents such as methylene chloride, trichloroethane, trichloroethylene, ethylene dichloride and perchloroethylene), and contaminants, such as polar solvents, which tend to co-distill with the desired solvent upon distillation.

It has been found that distillation alone of such a solvent composition is either difficult and expensive to achieve or is not adequate to separate the desired solvent from the contaminants, the contaminants co-distilling possibly even forming an azeotrope, with the desired solvent.

In one embodiment, the process of the present invention for recovering a desired solvent from a contaminated solvent composition containing the desired solvent and contaminants comprises:

(a) distilling the solvent composition to produce a bottom product and an overhead product, the overhead containing at least a portion of the contaminants and the desired solvent;

(b) contacting the overhead with an effective amount of sulfuric acid to remove a substantial portion of the contaminants to produce an acidified desired solvent and a spent sulfuric acid, the spent acid containing the removed contaminants; and (c) substantially neutralizing the acidified desired solvent to produce a recovered desired solvent.

Suitable distillation apparatus is well-known in the art, e.g. a conventional perchloroethylene still. A bottom product and an overhead product are produced. In distilling the contaminated solvent an overhead product is produced and usually contains some of the contaminants, e.g. polar contaminants of chemical residue, and the desired solvent, e.g. perchloroethylene.

The overhead product can then be transferred to a liquid-liquid contacting apparatus where it is contacted with an effective amount of sulfuric acid to remove a substantial portion of the contaminants. Preferably, the sulfuric acid is concentrated sulfuric acid, i.e., greater than about 85% concentration, preferably greater than about 96%, to minimize corrosion problems. The sulfuric acid reacts with and/or absorbs the contaminants. This contacting step forms two layers; a top layer which contains the acidified desired solvent, i.e. acidified perchloroethylene composition, and a spent sulfuric acid layer. The spent sulfuric acid layer contains contaminants extracted from the overhead product.

When a contaminated solvent containing a perchloroethylene and cyclohexanone blend is distilled, an overhead product is produced which contains recovered perchloroethylene and cyclohexanone. This overhead can, if relatively uncontaminated, be reused as is. If, however, it is not suitable for reuse due to too high a level of contaminants, degradation, etc., the overhead may be conveyed to a liquid-liquid contacting apparatus for contacting with sulfuric acid.

Since cyclohexanone cannot generally survive contact with sulfuric acid, most or all of the cyclohexanone can be lost if the cyclohexanone/perchloroethylene mixture is charged directly to the acid contacting apparatus. It is therefore preferable to first separate the cyclohexanone from the mixture, such as can be done by fractional distillation, and then contact the remainder of the solvent mixture, primarily contaminated perchloroethylene, with the sulfuric acid, the decontaminated perchloroethylene which is recovered from the sulfuric acid can then be reunited with the distilled cyclohexanone to reproduce the solvent mixture in an uncontaminated state suitable for reuse.

When the contaminated solvent is distilled, the bottom product can be highly viscous. For this reason, an embodiment of this invention includes the addition of a combustible diluent to the bottoms product. The diluent may be injected into the pipeline conveying the bottoms product away from the distillation equipment, or directly into the distillation equipment itself. Preferably, the diluent is injected directly into the distillation apparatus.

Direct addition of the diluent to the distillation apparatus reduces the viscosity of the bottoms product, helps to prevent the solidification of residues, assists in increasing yield of the desired solvent in the overhead product, e.g. perchloroethylene or perchloroethylene and cyclohexanone blend; and provides fuel value for the burning of the bottoms products.

The selection of the diluent depends to a large extent on the particular desired solvent being recovered. It is desirable that the diluent remain substantially liquid under the conditions of distillation, i.e. have a low volatility at the temperature and pressure of distillation. Its primary purpose however is to maintain a fluid, i.e. "pumpable", bottom product, and, if required, provide sufficient fuel value for the combustion or burning step.

Preferred diluents are high boiling hydrocarbons such as fuel, mineral oils and naphtha. Highly preferred for use in the process of cleaning tanks is fuel oil, particularly No. 2 fuel oil, for it supplies sufficient heating value for the burning and evaporation of most other components which may be present.

The quantity of diluent used may generally be categorized as an effective quantity for efficiently fluidizing the bottom product to prevent possible solidification and/or gelation of the bottom product under the conditions of distillation. The optimum amount of diluent employed will depend upon the particular solvent composition being treated, the particular diluent employed and the conditions of distillation. It has been found that a range of from about 10% to about 300% based on the volume of the solvent composition being distilled should be employed. A preferred range is from about 50% to about 200%.

The acidified perchloroethylene composition (produced by contacting the overhead with sulfuric acid to remove contaminants) is substantially neutralized by contacting the acidified composition with a base. Any base may be utilized which neutralizes the acidified perchloroethylene and does not affect its cleaning ability or decompose the solvent. Preferred bases are alkali metal and alkaline earth metal hydroxides, amines and carbonates. A preferred hydroxide is soda ash (sodium carbonate), because it is a solid and can be easily removed from the perchloroethylene after the neutralization although other alkaline metal hydroxides may also be used, e.g., sodium hydroxide, calcium hydroxide, etc. The base may also be an amine. A well known amine which can be used and which also stablizes perchloroethylene is N-methyl morpholine. This base, however, is less preferred than compositions such as sodium carbonate.

It is preferred that the spent sulfuric acid then be contacted with a high boiling hydrocarbon such as fuel oil or mineral oil, to extract any residual desired solvent, e.g. perchloroethylene, contained in the spent sulfuric acid. Such a contacting step is well known in the art and thus the apparatus and parameters for such liquid-liquid contacting may be readily determined by one skilled in the art. This contacting step may be performed in the same apparatus as the sulfuric acid contacting step or in a separate apparatus. Optionally, the spent sulfuric acid stream may be contacted, e.g. "sparged" with air to remove the entrapped solvent.

The hydrocarbons used to extract perchloroethylene from the spent sulfuric acid may be recovered from the sulfuric acid, neutralized and then charged to the contaminated solvent distillation apparatus as the hereinbefore described "diluent". At least part of the perchloroethylene contained in the hydrocarbon diluent can be recovered in the distillation apparatus if it is charged directly to it in this manner.

In order that the present invention be more fully understood, the following examples are given by way of illustration. No specific details or enumerations contained therein should be construed as limitations except insofar as they appear in the appended claims. All parts and percentages are by weight unless otherwise specifically designated.

EXAMPLE 1

Distillation of Contaminated Wash Solvent and Sulfuric Acid Contacting

A simulated sample of a contaminated perchloroethylene solvent was prepared containing 25%, by volume, chemical residue. The composition of this simulated sample was:

| | Volume (Mls.) |
|---|---|
| Perchloroethylene | 750.0 |
| 2-ethylhexylacrylate | 45.0 |
| butylacrylate | 30.0 |
| Isocyanates[1] | 20.0 |
| Styrene | 20.0 |
| Phthalates[2] | 12.5 |
| Fatty Acids[3] | 7.5 |
| Acetates[4] | 7.5 |
| Paints[5] | 2.5 |
| n-dodecyl mercaptan | 2.5 |
| Lube Oils[6] | 22.2 |
| Petrolatum | 25.0 |
| Resins[7] | 70.0 |
| Surfactants[8] | 12.5 |
| | 1027.5 |

[1]Isocyanates: Equal volumes of Mobay Mondur MR, MRS, M-432, MDI, Upjohn PAPI-135, 390-P. (Note: No TDI).
[2]Phthalates: Equal volumes of diethyl and dioctyl.
[3]Fatty Acids: Equal volumes of Emery Emfac 1210, P and G Tallow T-22, Hercules Pamak Tall Oil 4-47, and P and G Coconut C-110.
[4]Acetates: Equal volumes of n-amyl, butyl, ethyl, and ethylaceto.
[5]Paints: Equal volumes of Pittsburg Glass A16-710, B-16730, Quick Dry Enamel, PPG Multiprime, DuPont Topcoat, Sealer and Pretreatment 808-012.
[6]Lube Oils: Equal volumes of: Lubrizol 58, 78, 890, 936, 985, 1097, 1360, 1395, 3175, 3702, 3826A, 4426A, 5002, 6401, 6705. Exxon Paranox 12, 15, 24, 27, 30, 75, 100, 165. Rohm and Haas Acryloid 704, 940, 1019.
[7]Resins: Equal volumes of acrylics, epoxies and alkyds.
[8]Surfactants: Equal volumes of Rohm and Hass Triton CF-10, CF-32 and SF-17.

Fuel oil was added to this simulated sample of contaminated perchloroethylene. The volume of fuel oil was equal to about 25% volume of the sample. One grade of fuel oil, i.e. No. 2 was tested.

The sample with fuel oil was distilled at atmospheric pressure and a pot temperature of about 125° C. After distillation at these conditions the remaining bottom product was distilled at a reduced pressure. Distillation, generally proceeded as follows:

DISTILLATION DATA

| mm. Hg. | Pot Temp. (°C.) | Vapor Temp. (°C.) | Comments |
|---|---|---|---|
| No vacuum (Atmospheric) | 116 | 83 | First drop of distillate |
| | 119 | 110 | Rapid distillation |
| | 126 | 120 | |
| | 126 | 110 | |
| | 124 | 101 | |
| | 124 | — | |
| | 124 | — | Slow distillation |
| 400 | 95 | — | Boiling starts |
| 400 | 105 | 82 | |
| 400 | 105 | 95 | |
| 400 | 106.5 | 98 | Rapid distillation |
| | 106 | 68 | " |
| 100 | 69 | 61 | " |
| " | 72 | 67 | " |
| " | 82 | 74 | " |
| " | 99 | 87 | " |
| " | 110 | 80 | Distillation slow |

The distillate was analyzed by gas chromatography and determined to be 90.1% by weight perchloroethylene. It was noted that at the end of distillation the bottom residue contained 6.72% by weight perchloroethylene. After contacting the distillate with concentrated sulfuric acid, the acid washed perchloroethylene was found to contain 96.6% by weight perchloroethylene.

A similar contaminated solvent sample was distilled at 100 mm. Hg. The overhead contained 92.9% by weight perchloroethylene and the bottoms product contained 3.5% by weight perchloroethylene. After contacting the distillate with concentrated sulfuric acid, the acid washed perchloroethylene was found to contain 97.5% by weight perchloroethylene.

EXAMPLE 2

Sulfuric Acid Scrubbing of Solvent

A thousand milliliters of simulated sample of distilled contaminated perchloroethylene solvent containing 10% by volume chemical residues (see Example 1) and 90% perchloroethylene was contacted with 500 ml. of concentrated, i.e. about 96%, sulfuric acid and mixed to prevent phase separation of the layers. After five minutes of mixing the mixture was allowed to settle. Gas chromatography analysis indicated that the perchloroethylene layer was, within sample error, 100% perchloroethylene. The sulfuric acid layer contained 2.5% perchloroethylene.

EXAMPLE 3

Neutralization of Acid Washed Perchloroethylene

A sample of perchloroethylene which had been washed with sulfuric acid was brought into contact with calcium hydroxide pellets. This resulted in the neutralization of the acid contained therein and coalescence and settling of the dispersed calcium sulfate in the perchloroethylene. Subsequent to such settling treatment the perchloroethylene was further treated with N-methylmorpholine resulting in an acceptable perchloroethylene for reuse for cleaning tanks.

EXAMPLE 4

Sulfuric acid which had been used for washing distilled contaminated perchloroethylene was found to contain variable amounts of suspended perchloroethylene. An analysis of several different samples of such spent sulfuric acid indicated the presence of perchloroethylene in amounts ranging from about 0.14% to about 7% by weight. It was found that extraction, i.e. mixing/settling, of the spent sulfuric acid with a No. 2 fuel oil reduced the quantity of perchloroethylene to about 0.2–0.3% by weight. Extraction was also performed with Naphtha 140, and also found to reduce the perchloroethylene to a similar level.

Perchloroethylene could also be removed from the spent sulfuric acid by air sparging. The perchloroethylene in the gas phase can then be collected.

The objects set forth above, among those made apparent from the preceding description, are therefore effectively attained and, since certain changes may be made in the above process without departure from the steps of the invention, it is intended that all matter contained in the above description shall be interpreted as illustrative and not in a limiting sense.

We claim:

1. A method of removing a contaminant from the inner surface of a vessel comprising (a) contacting said inner surface with a solvent for said contaminant, said solvent comprising a chlorinated hydrocarbon, a polar solvent or a mixture thereof, to remove at least a portion of said contaminant and produce a contaminated solvent;

(b) collecting said contaminated solvent from said vessel;

(c) separating essentially all of the contaminant from said contaminated solvent to recover essentially all the solvent essentially free of said contaminant and produce a contaminant composition; and (d) combining said contaminant composition with a combustible composition comprising a high boiling hydrocarbon.

2. The method of claim 1 wherein said chlorinated hydrocarbon is perchloroethylene and said polar solvent is cyclohexanone.

3. The method of claim 1 wherein at least a portion of said contaminant is separated from said solvent by distillation.

4. The method of claim 3 wherein a combustible composition comprising a high boiling hydrocarbon is added to the bottoms product of said distillation.

5. The method of claim 4 wherein said combustible composition is fuel oil.

6. A method of removing a contaminant from the inner surface of a vessel comprising (a) contacting said inner surface with a solvent for said contaminant, said solvent comprising a chlorinated hydrocarbon, to remove at least a portion of said contaminant and produce a contaminated solvent;

(b) collecting said contaminated solvent from said vessel;

(c) distilling said contaminated solvent to produce an overhead product containing essentially all of said chlorinated hydrocarbon, and bottoms product;

(d) incinerating said bottoms product;

(e) washing said overhead product with sulfuric acid to remove remaining contaminant from the chlorinated hydrocarbon;

(f) neutralizing the washed chlorinated hydrocarbon by contacting or washing it with a base;

(g) washing the sulfuric acid with a combustible composition to remove any remaining chlorinated solvent therefrom and separating the combustible composition from the sulfuric acid.

7. The method of claim 6 wherein said neutralized chlorinated hydrocarbon is recycled to the beginning of the process and reused as a solvent for cleaning a contaminant from the inner surface of a vessel.

8. The method of claim 6 wherein after having been used to wash the sulfuric acid in step (g), said combustible composition is added to the bottoms product of step (c).

9. The method of claim 6 wherein said combustible composition is added to said bottoms product by injecting said combustible composition directly into the distillation equipment used to distill the contaminated solvent.

10. The method of claim 6 wherein said combustible composition is fuel oil.

* * * * *